US006036140A

United States Patent [19]

Tränapp et al.

[11] Patent Number: 6,036,140

[45] Date of Patent: Mar. 14, 2000

[54] MISSILE WITH SWINGABLE TRACKER

[75] Inventors: Norbert Tränapp, Piding; Michael Arnold, Bad Reichenhall; Matthias Grosse, Aufham; Reinhardt Krüger, Rückstetten/Teisendorf; Roland Gauggel, Salem, all of Germany

[73] Assignee: Buck Werke GmbH & Co., Uberkingen, Germany

[21] Appl. No.: 09/027,925

[22] Filed: Feb. 23, 1998

[30] Foreign Application Priority Data

Feb. 21, 1997 [DE] Germany ..... 197 06 958

[51] Int. Cl.[7] ..... F41G 7/22

[52] U.S. Cl. ..... 244/3.16

[58] Field of Search ..... 244/3.16, 3.17, 244/3.15, 3.19, 3.13; 356/139.03, 139.07, 152.2

[56] References Cited

U.S. PATENT DOCUMENTS

| | | | |
|---|---|---|---|
| 4,039,246 | 8/1977 | Voigt | 244/3.16 |
| 4,123,134 | 10/1978 | Meyers | 244/3.16 |
| 4,382,258 | 5/1983 | Tabourier | 342/110 |
| 4,413,177 | 11/1983 | Godwin, Jr. et al. | 244/3.16 |
| 5,201,895 | 4/1993 | Grosso | 244/3.16 |
| 5,279,479 | 1/1994 | Adama et al. | 244/3.16 |
| 5,333,815 | 8/1994 | Sardanowsky | 244/3.16 |
| 5,439,188 | 8/1995 | Depew, Jr. et al. | 244/3.21 |
| 5,669,580 | 9/1997 | Strauss | 244/3.16 |
| 5,847,675 | 12/1998 | Poinsard | 244/3.19 |

*Primary Examiner*—Charles T. Jordan
*Assistant Examiner*—Dinisi J Buckley
*Attorney, Agent, or Firm*—Burns, Doane, Swecker & Mathis, L.L.P.

[57] ABSTRACT

An unmanned cruise missile includes a swingable tracker having a homing head which detects targets using optical, infra-red, and/or radar wavelengths. The homing head is mounted on an internal two-axis cardanic roll-pitch tracking system which includes a cylinder mounted for rotation about a roll axis. The homing head is mounted on a pitch bearing which is rotatable relative to the cylinder about a pitch axis. The homing head is rotatable relative to the pitch bearing about a yaw axis. A mirror of the homing head has a recess formed therein to enable the homing head to swing a greater distance without abutting the cylinder.

16 Claims, 4 Drawing Sheets

MISSILE WITH SWINGABLE TRACKER

BACKGROUND OF THE INVENTION

The invention involves a swingable (slewable) tracker that can optionally detect in the optical, infra-red or radar wavelength and accordingly manifests an optical component and a detector component and/or a radar antenna component, and that preferably is equipped with an optical component for use in the IR range, which is constructed as a corrected mirror optic, preferably a Cassegrain optic with a large entry aperture. The tracker typically is used in the IR range as a homing head for a missile, preferably an unmanned one with a cruise engine or a similar missile, to acquire and/or engage fixed and/or moving targets, like helicopters or similar vehicles. The homing optic is housed in a movable manner by means of a two-axis, cardanic, roll-pitch-tracking system in an exterior housing rigidly connected to the missile structure and electro-mechanically executes the tracking and scanning motions that serve to acquire the target.

From the state of technology it is known how to use electro-mechanical, two-axis reference systems to track optical systems, like cameras among other things, for infra-red homing heads of missiles and the like. As a rule, two-axis reference systems are generally used in the process.

A widely used construction principle is the combination of a pitch and a yaw reference in conjunction with an external cardanic reference, whereby "pitch" means a turning motion of the optical system around the tracker's fixed Y axis and "yaw, a turning motion of the optical system around the tracker's fixed Z axis. The fixed coordinate system is thereby usually defined by the construction location of the tracker which is characterized as a rule by the axes being parallel to the fixed missile axes. The deflection angles describe movements around the tracker's fixed coordinate axes. The angles are measured outward from the non-moving, tracker construction location.

In such systems the deflection angles, also called squint angles, of the optical system can be determined very easily. With an exterior cardanic system the corresponding angles can be measured conventionally in conjunction with distance sensors on exterior positions. Because of the possible large separation between the distance sensor and the rotation axis, significant distance changes occur in response to angular changes which, as a rule, make it possible to achieve satisfactory measurement resolution (pick-up accuracy) by the deflection angle sensors. Another advantage of the exterior cardanic system consists of the pick-up and moment indicators being decoupled, i.e., motion in the pitch axis does not couple with the yaw pick-up and vice-a-versa. Systems of this type have been known for a long time.

A disadvantage of the arrangement described consists of there being only limited available construction room for the optical system because of its exterior location. Thus normally for a given light intensity (entrance aperture) the construction area required is somewhat greater than the operational capability of the optical system (volume of the tracker optic). Another disadvantage is the large amount of moving parts which is caused by the required size of the pitch and yaw frames of references as a well as the large bearing surfaces. The large number of moving parts and, as a rule, the higher bearing friction lead to correspondingly high positioning power and a significant energy requirement when the optical system has to be moved or tracks an object, whereby a lot of problems result especially when used in the tracking systems of missiles of the type described at the outset.

Another roll-pitch-tracking system is known which is also constructed as an external cardanic system. Here there are also similar problem areas. The rolling, i.e. the turning motion of the optical system around the fixed missile X axis, is hereby made possible by an externally located rolling contact bearing, whereby, however, there is also a large mass to be moved and a correspondingly high positioning power and significant energy requirement. The externally located rolling contact bearing can also lead to limitations in the available construction volume for the reasons already discussed above.

An interior cardanic solution brings significant improvements with respect to the problem areas previously described. It is known to take the form of a pitch-yaw-tracking system which is constructed as an internal cardanic system, wherein the mechanical reference frame system are disposed in the interior area of the tracker. Because of the smaller bearing surfaces, the available construction volume, especially with regard to the entrance aperture, can be better utilized and is smaller overall. Simultaneously all moving parts, especially the bearing and reference frame parts, can be constructed with more favorable weight, whereby the required positioning power as well as the resultant bearing friction are smaller. On the other hand, the squint angle pick-ups can certainly no longer be constructed in a simple fashion with the state of technology associated with internal cardanic systems. Also, with the use of an interior cardanic system, there is no possibility, as a rule, of measuring the squint angles in the area of the interior bearings, since the available construction volume is too small to house the sensors in the area of the interior cardanic system.

Thus as a general rule, a displacement of the angle pick-up sensors to the external area of the seeker or tracker head is sought. Here, too, the attainable measurement quality is limited by the coupling of the pitch and yaw motions of the cardanic frame of reference. By displacing the angle pick-up sensors to the exterior (away from the rotational axes) a turning motion around a tracker axis automatically leads to an influencing of the angle measurement around the correspondingly opposite cardanic axis. The pick-up of the pitch axis is simultaneously influenced by a yaw motion and vice-a-versa. These non-linear coupling effects cause technical measurement problems with respect to a high degree of pick-up accuracy and are recognized as increased "noise" in the subsequent correction of the angle measurement. Another problem of the pitch-yaw-reference system in an interior cardanic version consists of the squint angle range being limited by the primary mirror "striking" the rolling-contact-bearing housing. This problem can be minimized by a conceivable, asymmetrical mounting of the entire seeker head in the missile structure, yet this measure is not ever considered because of technical guidance reasons, since severe limitations could result for the operating range of the tracker because of the asymmetrical squint angle.

SUMMARY OF THE INVENTION

This invention has the object of further developing a tracker of this type normally used with a roll-pitch-tracking system configured as an external cardanic system, that with less weight and the smallest possible construction volume a greater squint angle range is realized without adversely affecting the angle measurement indicators and moment indicators by means of coupling the measurement information for exterior mounted angle pick-up sensors.

The object will be accomplished in the invention by further developing a tracker of this type in such a way that the roll-pitch-tracking system is configured as an internal cardanic system rather than as an external cardanic system.

Provisions can thereby be made for the optical and detector components to be supported via a pitch bearing with a pitch axis perpendicular to the tracker longitudinal axis by a cylindrical rotary component which revolves around the exterior housing axis by means of a roll bearing supported on the external housing.

Provisions can thereby be made for the exterior housing axis being positioned coincident with (parallel to) the missile longitudinal axis.

Provisions can also be made for the primary mirror to incorporate a preferably slit-shaped recess for the swiveling of the cylindrical rotary component in order to facilitate the roll motion of the tracker optic.

Another embodiment of the invention provides for two roll-reference-moment indicators on the cylindrical rotary component to convey the steering moments via the electro-mechanical pitch-moment indicators which are linked to the tracker optic in order to achieve the pitch motion.

The invention also proposes that the pitch-reference-moment indicators run parallel to each other and are located on a connection flange on both ends of the same roll-moment indicator in order to convey the driving torque for the roll motion.

Provisions are also made for at least one revolving, roll-reference-moment indicator to be securely attached to the exterior housing in order to detect the roll moments.

The invention also provides for the pitch-reference-moment indicators being arranged in a symmetrical manner.

Provisions are also made for the pitch-reference-moment indicators being arranged in an asymmetrical manner.

The invention is based on the surprising knowledge, that the object can be successfully satisfied and a tracker with extensively optimized characteristics can be created by using a roll-pitch-tracking system that is configured as an internal cardanic system.

The principle of the tracking system in the invention is based on an electro-mechanical, multi-axis reference system for tracking optical systems like, for example, infra-red seeker heads in missiles, whereby the reference system consists of pitch and roll references configured as an interior cardanic system. The features of the invention make possible an especially compact and easy method of construction with a simultaneously high squint angle range.

The tracker of the invention can be realized both with a symmetrical as well as an asymmetrical squint angle range. The tracking system of the invention can basically be configured with varying arrangements of the positions, whereby, however, an essential aspect of the invention must always be retained, namely, that the roll-pitch-tracking system must be configured as an internal cardanic system. Numerous locations for the electro-mechanical moment indicators and the moment-indicator frames of reference are conceivable.

In the event that the squint angle must be increased still further, consideration should be given to an asymmetrical arrangement of the pitch-reference-moment indicators. For larger squint angles the primary mirror of the optical system can also move the "striking" of the mirror against the envisioned cylindrical component of the preferred embodiment by an axial displacement in the direction of the optical seeker axis (toward the tip of the missile). Finally a definitely increased squint angle range can be attained in the favored execution model of the invention by the primary mirror incorporating a recess corresponding to the cylindrical component.

While in the current state of technology roll-pitch seeker heads can only be realized as external cardanic systems whereby greater dimensions primarily result as compared to an internal cardanic system for the same sized optical entrance aperture, and while the use of an internal cardanic pitch-yaw system leads to limitation of the squint angle which can only be circumvented under certain circumstances for special tasks by an inclined mounting of the tracker, the solution of this invention, namely an internal cardanic system with a roll-pitch arrangement, optimally solves the issue, whereby both a symmetrical as well as an asymmetrical solution (based on a rotating coordinate system fixed on the tracker) without an inclined arrangement can be utilized. The tracking system achieves a greater squint angle range than other comparable tracking systems, whereby the angle indicators and the moment indicators are kinematically de-coupled with respect to the axial coupling effects. The squint angle range can be extensively optimized by locating the primary mirror of the tracking optic at various positions in the axial direction and also by the primary mirror of the preferred execution model of the invention being slit corresponding to the dimensions of the cylindrical component mounting the bearings.

BRIEF DESCRIPTION OF THE DRAWINGS

Other features and advantages of the invention can be seen in the following description and the execution models explained on the basis of the schematic drawings and in which.

DETAILED DESCRIPTION OF PREFERRED

Embodiments of the Invention

Figure 1:
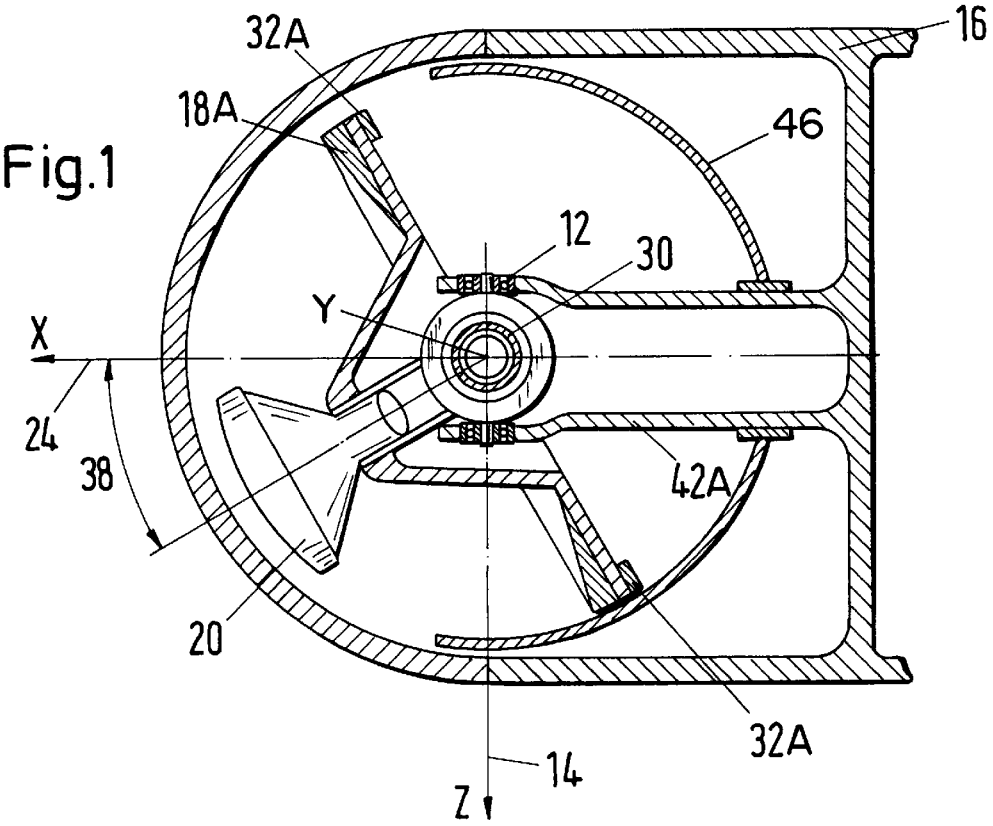
FIG. 1 shows a side view of a conventional pitch-yaw-tracking system configured as an internal cardanic system.

In a conventional two axis, optical, pitch-yaw-tracking system configured as an internal cardanic system shown in FIG. 1, it can be recognized that the danger exists at a relatively large deflection angle 38 as well as in the pitch and yaw direction, of the primary mirror of the homing head 18A striking against the cylindrical component 42A which preferably extends parallel to the missile longitudinal axis as shown. A moment (momentum) indicator 32A serves to convey the momentum as well as to measure the deflection angle (i.e., in the manner of an angular pick-up sensor). The pitch bearing 30 and the yaw bearing 12 are shown in a sectioned view.

Figure 2:
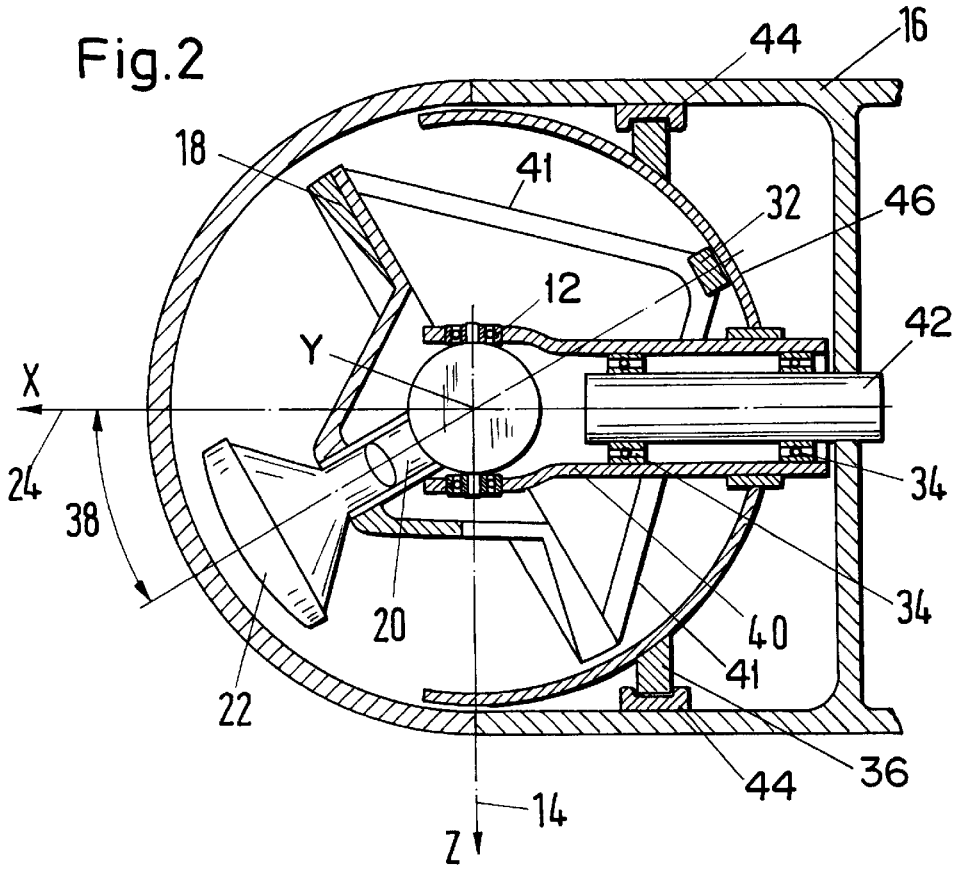
FIG. 2 depicts a side view of a first preferred embodiment of the invention for a roll-pitch-tracking system configured as an internal cardanic system.

In the first preferred embodiment of the seeker or tracker head of the invention shown in FIG. 2, in which the deflection angle 38 about the pitch bearing 30 is also shown in the overhead view, the homing head 20 is located on a cylindrical rotary component 40 which preferably, as shown, extends along (parallel to) the missile longitudinal axis. The cylindrical component 40 revolves around roller bearings 34 in relation to the external housing axis X, i.e., a roll axis.

Figure 3:
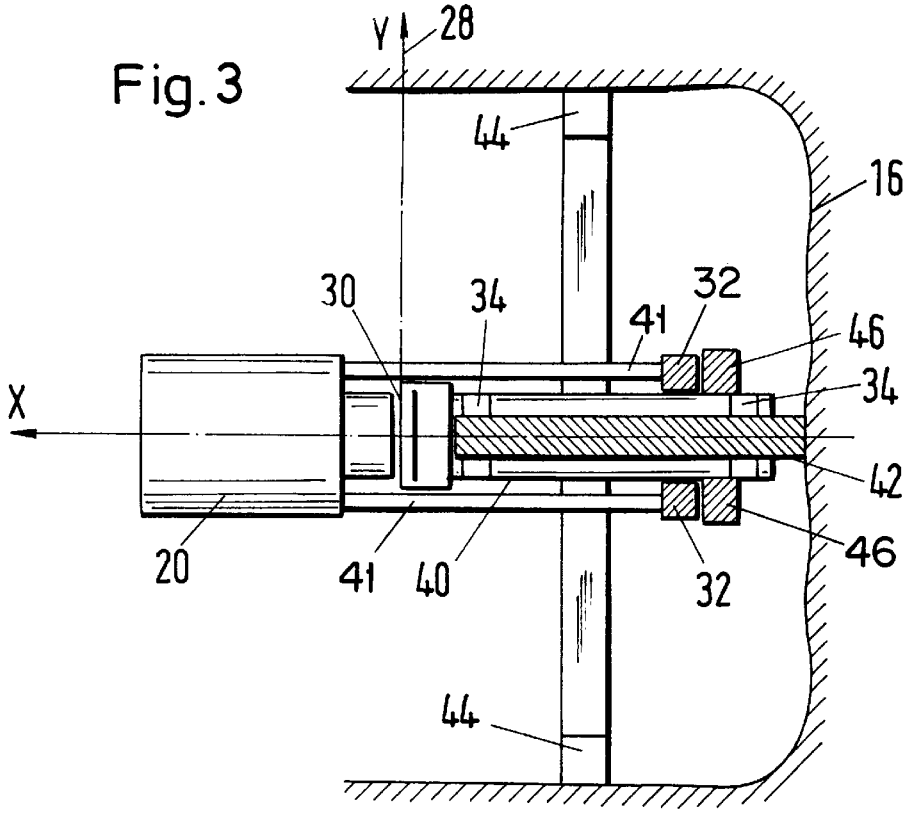
FIG. 3 is a schematic view from above of the embodiment depicted in FIG. 2.
Figure 4:
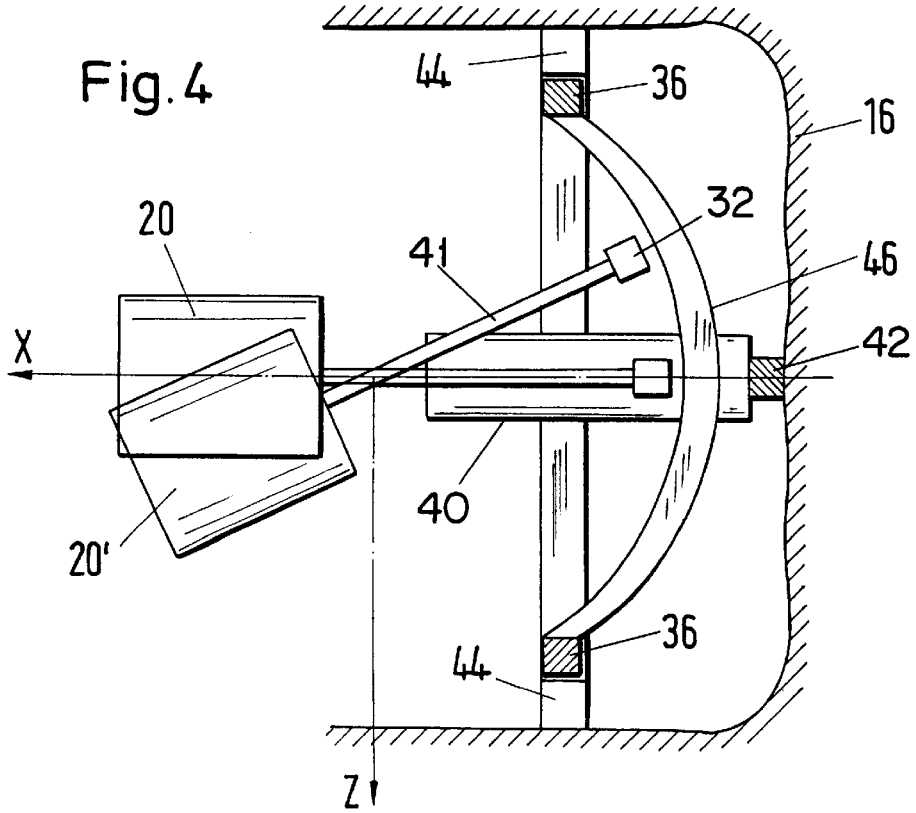
FIG. 4 is a side view of the embodiment depicted in FIG. 3.

In the other depictions of the first embodiment seen in FIGS. 2, 3 and 4 a roll-reference-moment (momentum) indicator 44 and a pitch-reference-moment indicator 46 function together with the electro-mechanical roll-moment indicator 36 as is evident from the drawing. In FIG. 4, number 20' shows the deflected location of the homing head 20 when turning around the pitch axis Y.

Figure 8:
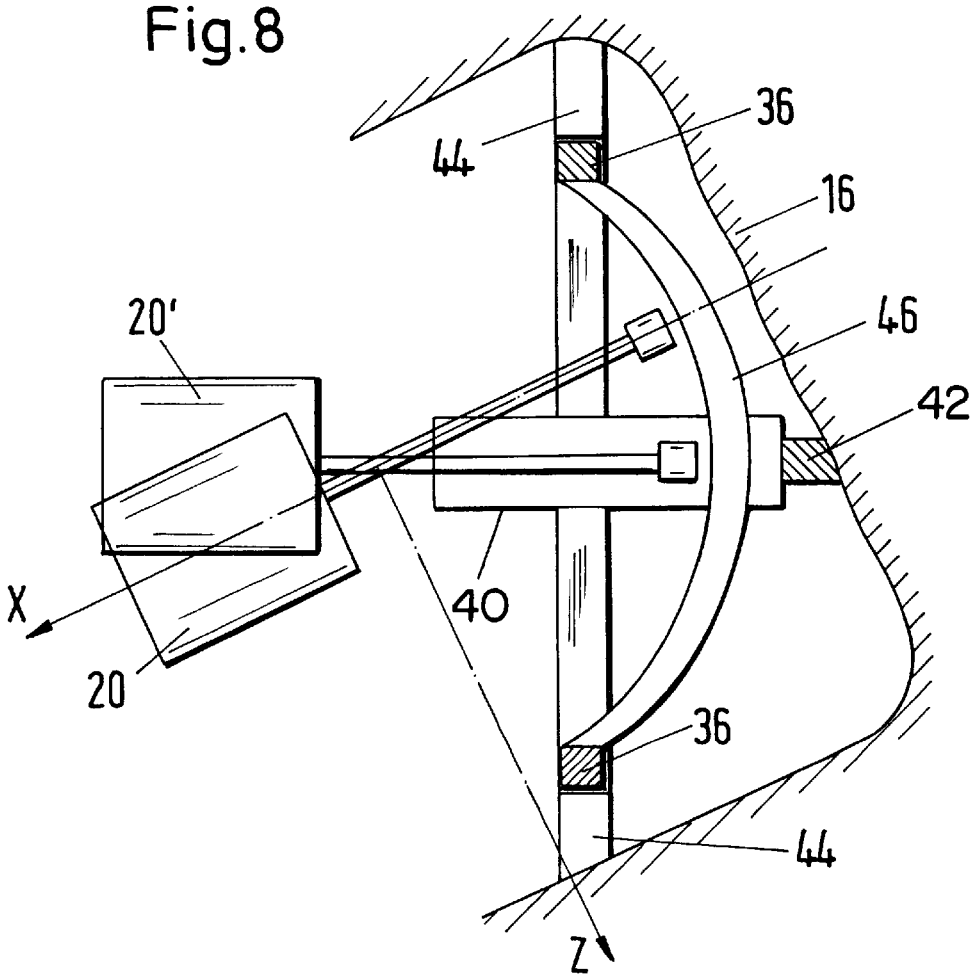
FIG. 8 is a view similar to FIG. 4 of a third embodiment, having an asymmetrical squint angle range.

The tracker of FIGS. 3 and 4 can be constructed either with a symmetrical or an asymmetrical squint angle range. FIG. 8 depicts the asymmetrical squint angle range. A cylindrical axle 42, connected in a rigid manner with the external housing 16 of the missile structure serves for supporting the cylindrical component 40. These two components 40, 42 are interconnected by the roll bearing 34, such that a roll position can be attained. Two pitch-reference-moment indicators 46 serve to convey the driving torques via the electro-mechanical pitch-moment indicators 32 in the conventional manner to achieve the pitch motion. Those indicators are fixed to the cylindrical component 40 which supports the homing head 20 by means of the pitch bearing 30. The conveyance of the driving torque for the roll motion occurs by means of two electro-mechanical roll-moment indicators 36 which are mounted on a connecting flange of respective ones of the parallel pitch-reference-moment indicators 46. The roll moments (movements) are detected by roll-reference-moment indicators 44 that are rigidly connected to the external housing 16. The advantage of positioning the electro-mechanical pitch-moment indicators in the rear area of the tracker can be seen in the simultaneous conveyance of larger moments because of the larger lever arm and in the easily attained weight compensation of the homing head (view finder optic) 20 in relation to the pitch axis.

Figure 5:
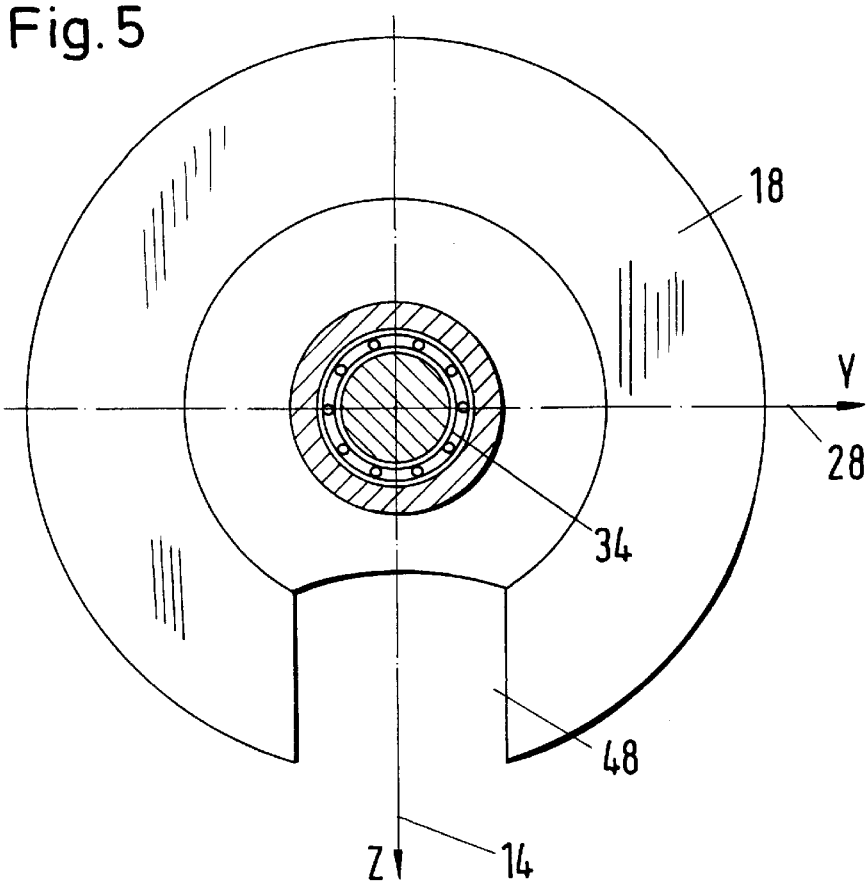
FIG. 5 depicts a rear view of a second embodiment of a mirror portion of the homing head in one angular position.
Figure 6:
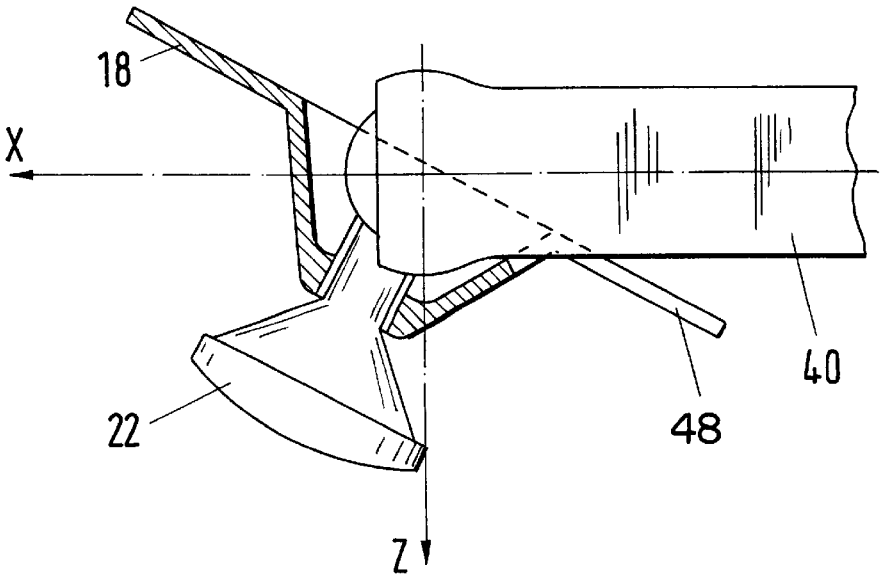
FIG. 6 is a side view of the mirror of FIG. 6 after being rotated about a pitch axis.
Figure 7:
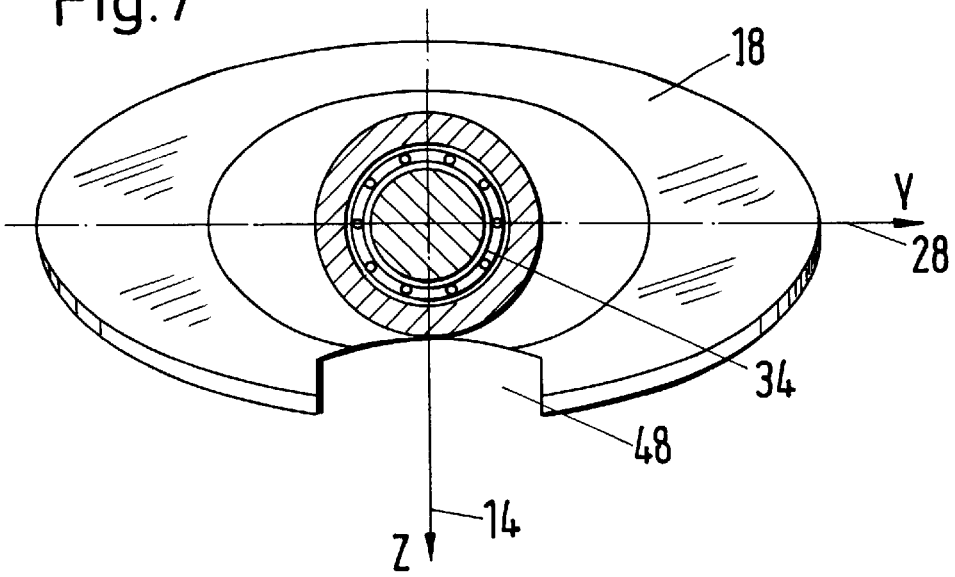
FIG. 7 shows a rear view of the mirror of FIG. 6.

It can be seen in FIGS. 5, 6 and 7 that the primary mirror 18 can be provided with a slit, whereby the primary mirror 18 is capable of large deflection angles 38 without striking against the cylindrical component 40. Hence, the recess or slit 48 formed in the primary mirror 18 ensures a basically greater squint angle amplitude than can be achieved in the absence of such a recess and thus is of great significance for the concept of this invention. A similar slit could be provided in the mirror shown in FIG. 1.

Although each of the indicators 32 and 36 serves both as an angle sensor and to convey movement signals, there could instead be employed multiple sensors for performing respective ones of those functions.

Although the present invention has been described in connection with preferred embodiments thereof, it will be appreciated by those skilled in the art that additions, deletions, modifications, and substitutions not specifically described may be made without departing from the spirit and scope of the invention as defined in the appended claims.

What is claimed is:

1. In a missile comprising a housing and a tracker mounted in the housing, the tracker including a homing head mounted on a two-axis cardanic roll-pitch-tracking system for electro-mechanically performing tracking and scanning motions relative to a target, the improvement wherein the cardanic roll-pitch-tracking system comprises an internal cardanic system.

2. In the missile according to claim 1 wherein the internal cardanic system includes a rotary cylinder mounted to the housing by a bearing arrangement to be rotatable relative to the housing about a roll axis, a pitch bearing mounted on the cylinder, the homing head mounted to the pitch bearing for rotation about a pitch axis oriented perpendicular to the roll axis.

3. In the missile according to claim 2 wherein the pitch bearing is rotatable relative to the cylinder about a yaw axis oriented perpendicular to the roll axis and pitch axis.

4. In the missile according to claim 2 wherein the roll axis is oriented parallel to a longitudinal axis of the missile.

5. In the missile according to claim 2 wherein the homing head includes a primary mirror having a recess extending therethrough to enable the cylinder to enter the recess during swiveling of the head.

6. In the missile according to claim 5 wherein the internal cardanic system further includes two pitch-reference momentum indicators fixed to the cylinder, and electro-mechanical pitch momentum indicators affixed to the homing head and arranged to move adjacent respective ones of the pitch-reference-movement indicators.

7. In the missile according to claim 6 wherein the internal cardanic system further includes roll-movement indicators mounted on respective ones of the pitch-reference momentum indicators for movement therewith about the roll axis.

8. In the missile according to claim 7 wherein the internal cardanic system further includes at least one roll-reference-momentum indicator fixed to the housing, the roll-movement indicators arranged to move adjacent to the at least one roll-reference movement indicator.

9. In the missile according to claim 2 wherein the internal cardanic system further includes two pitch-reference momentum indicators fixed to the cylinder, and electro-mechanical pitch momentum indicators affixed to the homing head and arranged to move adjacent respective ones of the pitch-reference-movement indicators.

10. In the missile according to claim 9 wherein the internal cardanic system further includes roll-movement indicators mounted on respective ones of the pitch-reference momentum indicators for movement therewith about the roll axis.

11. In the missile according to claim 10 wherein the internal cardanic system further includes at least one roll-reference-momentum indicator fixed to the housing, the roll-movement indicators arranged to move adjacent to the at least one roll-reference movement indicator.

12. In the missile according to claim 11 wherein the two pitch-reference-movement indicators are arranged asymmetrically relative to one another.

13. In the missile according to claim 6 wherein the two pitch-reference movement indicators are arranged asymmetrically relative to one another.

14. In the missile according to claim 1 wherein the homing head detects in an optical wavelength.

15. In the missile according to claim 1 wherein the homing head detects in an infra-red wavelength.

16. In the missile according to claim 1 wherein the homing head detects in a radar wavelength.

* * * * *